US005823227A

United States Patent [19]

Hori et al.

[11] Patent Number: 5,823,227

[45] Date of Patent: Oct. 20, 1998

[54] HYDRAULIC PILOT VALVE

[75] Inventors: Shuji Hori; Kei Kawabata; June Maruyama, all of Tochigi-ken, Japan

[73] Assignee: Komatsu, Ltd., Tokyo, Japan

[21] Appl. No.: 836,259

[22] PCT Filed: Nov. 14, 1995

[86] PCT No.: PCT/JP95/02327

§ 371 Date: May 9, 1997

§ 102(e) Date: May 9, 1997

[87] PCT Pub. No.: WO96/15374

PCT Pub. Date: May 23, 1996

[30] Foreign Application Priority Data

Nov. 14, 1994 [JP] Japan ..... 6-278989

[51] Int. Cl.[6] ..... F15B 13/02

[52] U.S. Cl. ..... 137/636.1; 91/426; 137/596.1; 251/297

[58] Field of Search ..... 91/426; 137/596.1, 137/636.1, 636.2; 251/297

[56] References Cited

U.S. PATENT DOCUMENTS

| | | | |
|---|---|---|---|
| 4,342,335 | 8/1982 | Reinicker et al. | 137/596 X |
| 4,530,376 | 7/1985 | Chatterjea | 91/426 X |
| 4,566,492 | 1/1986 | Bessard | 91/426 X |

FOREIGN PATENT DOCUMENTS 2-56985 4/1990 Japan .

*Primary Examiner*—Gerald A. Michalsky

*Attorney, Agent, or Firm*—Wenderoth, Lind & Ponack, L.L.P.

[57] ABSTRACT

A hydraulic pilot valve, including a plurality of pressure reduction valve portions, each having an inlet port, an outlet port and a pressure regulating valve for establishing and blocking communication between both ports by movement of the pressure regulating valve, a plurality of pistons actuating the pressure regulating valves of the pressure reduction valve portions in the direction establishing communication, an operation lever having a pushing member pushing the plurality of pistons, and springs for biasing the pistons upwardly beyond a neutral position to retain them in an abutting relation with a pushing member. An operating lever is rocked from the neutral position in one direction to place the lever in an actuating position and push one piston to place one of the pressure reduction valve portions in a pressurized fluid supply condition to establish communication between the inlet portion and the outlet portion. A switching valve portion, provided in the other piston assumes a valve open position when the other piston is pushed up. Also, a pressure receiving chamber is provided for pushing up at least one of the other pistons, other than the one piston among a plurality of pistons, so as to maintain the operation lever at the actuating position. The pressure receiving chamber is constructed so as to communicate the pressure receiving chamber with the outlet port of the one pressure reduction valve portion via the switching valve portion.

7 Claims, 4 Drawing Sheets

HYDRAULIC PILOT VALVE

TECHNICAL FIELD

The present invention relates to a hydraulic pilot valve to be used for switching operating valves for supplying a pressurized fluid to hydraulic cylinders in a construction machine and in an industrial machine.

BACKGROUND ART

As operating valve for supplying pressurized fluid to a hydraulic cylinder of a construction machine, it has been known that a pilot actuation type operating valve, in which a spool bore is provided in a valve body, a spool is disposed within the spool bore slidably between a neutral portion and a pressurized fluid supply position. The spool is maintained at the neutral position by means of a spring, and the spool is move toward to the pressurized fluid supply position by the pressurized fluid supplied to a pressure receiving portion provided at the end portion side of the spool. In order to switch the pilot actuation type operating valve, the pressurized fluid is supplied to the pressure receiving portion from a hydraulic pilot valve.

Various valves have been employed in the prior art as the hydraulic pilot valve known. For example, as disclosed in Japanese Unexamined Utility Model Publication (Kokai) No. Heisei 2-56985, a hydraulic pilot valve is provided with a pressure reduction valve portion, a piston for actuating the pressure reduction valve and being returned to the neutral position by means of the spring, a pushing member for pushing down the piston, and an operation lever rockable between the neutral position and the actuating position. The operation lever is pushed down by a pushing member against the spring from the neutral position to the operating position to push down the piston to place the pressure reduction valve portion into pressure supply state.

In the above-mentioned hydraulic pilot valve, a detent device, constituted of a attraction disc and a attracting coil, is provided so that the attracting coil may bias the attraction disc when the pressure reduction valve portion is placed at the pressurized fluid supply position by rocking the operation lever from the neutral position to the actuating position. Thus, even when a hand is released from the operation lever, the operation lever will not be return to the neutral position by the spring force and is thus maintained at the actuating position.

However, the hydraulic pilot valve constructed as set forth above requires a space for providing the attraction disc and the attracting coil. Thus, the overall device becomes bulky. Also, the attracting coil requires a power source for supplying power to the attracting coil which results in higher costs.

Therefore, the present invention has been developed in view of the problems set forth above. Accordingly, it is an object of the present invention to provide a hydraulic pilot valve which makes the overall valve compact and the production cost low.

DISCLOSURE OF THE INVENTION

In order to accomplish the above-mentioned object, according to one aspect of the invention, there is provided a hydraulic pilot valve, in which a plurality of pressure reduction valve portions, each having an inlet port, an outlet port and a pressure regulating valve for establishing and blocking communication between both ports by movement of the pressure regulating valve, a plurality of pistons actuating the pressure regulating valves of the pressure reduction valve portions in the direction establishing communication, an operation lever having a pushing member pushing the plurality of pistons, and springs for biasing the pistons upwardly beyond the neutral position to retain them in abutting contact on the pushing members, so that, by rocking the operation lever from the neutral position in one direction to place it at an actuating position to push one piston to place one of the pressure reduction valve portions in a pressurized fluid supply condition to establish communication between the inlet portion and the outlet portion. A switching valve portion is provided in the other piston which assumes a valve open position when the other piston is pushed up. Also, a pressure receiving chamber for pushing up at least one of the other pistons other than the one piston among a plurality of pistons so as to maintain the operation lever at the actuating position, is constructed so as to communicate the pressure receiving chamber to the outlet port or the inlet port of the one pressure reduction valve portion via the switching valve portion.

With the construction set forth above, by operating the operation lever from the neutral position in one direction to place one of the pressure reduction valve portions in the pressurized fluid supply position, and to allow the other piston to be placed at pushed up condition. Then, the switching valve portion is opened and the pressurized fluid of one of the pressure reducing valve portion is supplied to the pressure receiving chamber for the other piston to push up and hold the other piston so that even when a hand is released from the operation lever, the operation lever is retained in the actuating condition.

Also, the only necessary construction is that in which the switching valve portion and the pressure receiving chamber are formed to supply the pressurized fluid to the pressure receiving chamber via the switching valve portion. Therefore, number of parts becomes smaller to make the overall valve compact, and to make the production costs lower.

Besides, in the construction where the pressurized fluid of the outlet portion of the other pressure reduction valve portion is supplied to the pressure receiving chamber of one pressure reduction valve portion via the switching valve portion, when the operation level is in the neutral position, the other pressure reduction valve portion is in the pressurized fluid supply stop condition so as not to permit flow of the pressurized fluid through the switching valve portion, and fluid leakage or so forth should not be caused.

Moreover, in the construction set forth above, it is preferred that the switching valve portion is constructed with a port communicating with the outlet port or the inlet port of one of the pressure reduction valve portion, and a cut-out portion to communicate the pressure receiving chamber to the port when the piston is pushed up beyond the neutral position for a predetermined distance.

In addition to the construction set forth above, it is preferable that a member is provided to increase the resistance against a downward pushing down force when the one of the pistons is pushed down beyond a predetermined distance by the pushing member.

With the construction set forth above, when the operation lever is rocked beyond a predetermined angle, a resistance against the downward movement of the piston of the other pressure reduction valve portion is abruptly increased, the operator operating the operation lever may percept the specific operation magnitude.

BRIEF DESCRIPTION OF THE DRAWINGS

The present invention will be understood more fully from the detailed description given herebelow and from the accompanying drawings of the preferred embodiment of the invention, which, however, should not be taken to limit to the present invention, but are for explanation and understanding only.

In the drawings.

BEST MODE FOR IMPLEMENTING THE INVENTION

The preferred embodiment of a hydraulic pilot valve according to the present invention will be discussed hereinafter with reference to the accompanying drawings.

Figure 1:
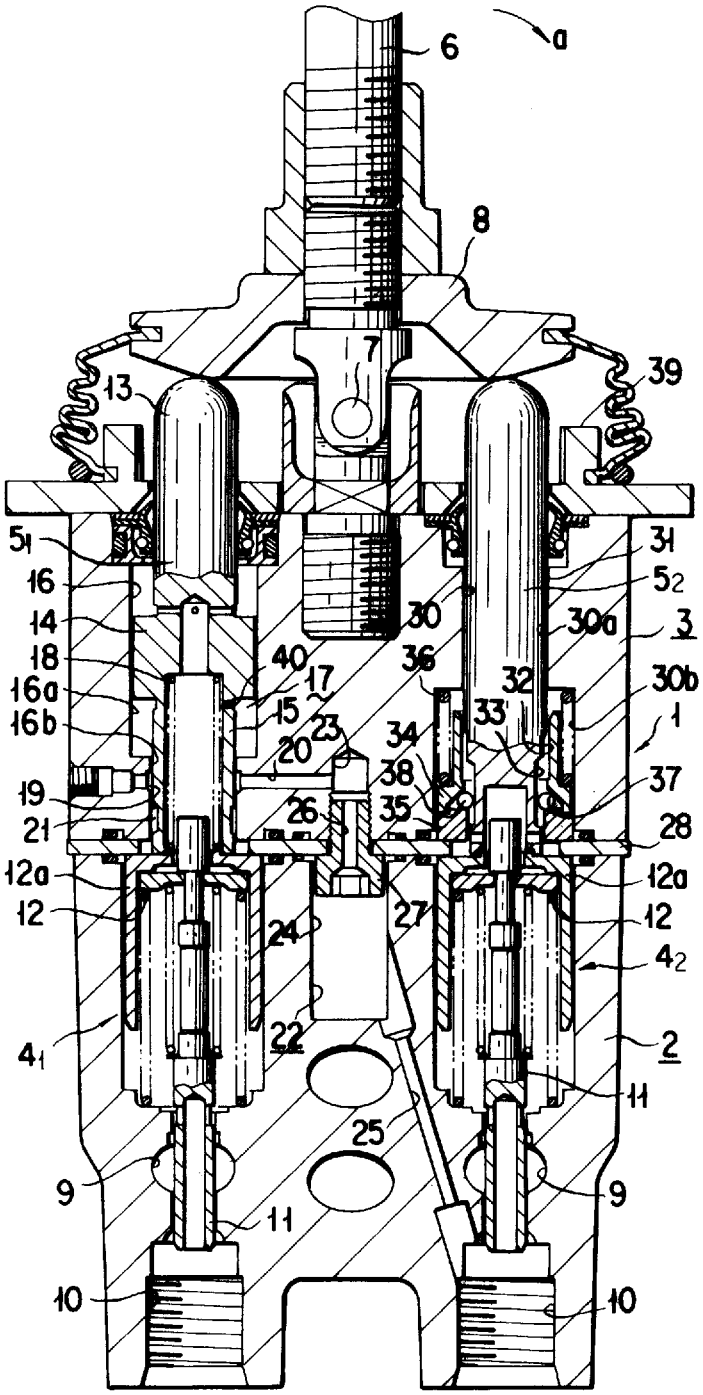
FIG. 1 is a sectional view showing a neutral position of a first embodiment of a hydraulic pilot valve according to the present invention.

As shown in FIG. 1, a valve body 1 is constructed of a lower body 2 and an upper body 3. In the lower body 2, first and second pressure reduction valve portions $\mathbf{4}_1$ and $\mathbf{4}_2$ are arranged in a parallel relationship. In the upper body 3, first and second pistons $\mathbf{5}_1$ and $\mathbf{5}_2$ for actuating the first and second pressure reduction valve portions $\mathbf{4}_1$ and $\mathbf{4}_2$ are provided. Furthermore, in the upper body 3, an operation lever 6 is rockably supported by means of a universal joint 7. A pushing member 8 is mounted on the operation lever 6 for pushing down the first and second pistons $\mathbf{5}_1$ and $\mathbf{5}_2$.

The first and second pressure reduction valves portions $\mathbf{4}_1$ and $\mathbf{4}_2$ have respectively input ports 9 and output ports 10 and pressure regulation valves 11 for establishing and blocking communication between both ports 9 and 10. The pressure regulation valves 11 are pushed up and held at a blocking position by a spring 12.

The first piston $\mathbf{5}_1$ has an upper smaller diameter portion 13, an intermediate large diameter portion 14 and a lower smaller diameter portion 15. The intermediate large diameter portion 14 engages with an upper large diameter bore 16*a* of a first piston insertion bore 16 which is a stepped bore of the upper body 3, the lower small diameter portion 15 engages with a lower small diameter bore 16*b* to form a pressure receiving chamber 17 for pushing up the first piston $\mathbf{5}_1$. Also, the first piston $\mathbf{5}_1$ is pushed up by the spring 18 supported by a cylindrical spring seat 12*a* to abuts the head portion against the pushing member 8.

On the lower small hole 16*b* of the stepped bore 16, an annular groove 19 is formed. The annular groove 19 opens to a port 20. On the small diameter portion 15 of the first piston $\mathbf{5}_1$, an annular cut-out portion 21 for establishing and blocking communication between the annular groove 19 and the pressure receiving chamber 17, is formed. These form a switching valve portion.

The port 20 communicates with an outlet port 10 of the second pressure reduction valve portion $\mathbf{4}_2$ via a communication fluid passage 22. The communication fluid passage 22 is constituted of an upper bore 23 formed in the upper body 3, a lower bore 24 formed in the upper body 2 and a fluid passage 25. To the upper bore 23, an upper portion of a plug 27 which has an axial bore 26 is threadingly engaged. A lower portion of the plug 27 is engaged with the lower bore 24. By this, upon connecting the lower body 2 and the upper body 3 via a plate 28, they can be positioned by the plug 27.

The second piston $\mathbf{5}_2$ is inserted into the second piston insertion bore 30 and located at a position between the spring seat 12*a* and the pushing member 8 of the second pressure reduction valve portion $\mathbf{4}_2$. The second piston $\mathbf{5}_2$ is of a sufficient length to contact with the spring seat 12*a* and the pushing member 8 when the operation lever 6 is in the neutral position, namely when the first and second pressure reduction valve portions $\mathbf{4}_1$ and $\mathbf{4}_2$ do not supply the pressurized fluid. Also, the second piston $\mathbf{5}_2$ is formed into a stepped configuration with an upper large diameter portion 31, an intermediate small diameter portion 32 and a lower small diameter portion 33.

The second piston insertion bore 30 is a stepped bore having an upper small diameter bore 30*a* and a lower large diameter bore 30*b*. To the upper small diameter bore 30*a*, the upper large diameter portion 31 of the second piston $\mathbf{5}_2$ is slidably engaged. A movable ring 34 and a stationary ring 35 are provided in the lower diameter bore 30*b*. By pushing down of the movable ring 34 downwardly by a spring 36, a ball 38 provided between a funnel shaped recess 37 of the movable ring 34 and the stationary ring 35 are biased onto the lower small diameter portion 33 of the second piston $\mathbf{5}_2$.

Next, the operation of the illustrated embodiment will be discussed.

At the neutral position of the operation lever 6, the first piston $\mathbf{5}_1$ is pushed up by the spring 18 so that it abuts against the pushing member 8 to block the communication between the annular groove 19 and the pressure receiving chamber 17 by the lower small diameter portion 15 of the first piston $\mathbf{5}_1$. At this time, in the first and second pressure reduction valve portions $\mathbf{4}_1$ and $\mathbf{4}_2$, respective pressure regulating valves 11 are pushed up by respective springs 12. Thus, communication between respective inlet ports 9 and respective outlet ports 10 are blocked so that the pressurized fluid is not supplied.

Figure 2:
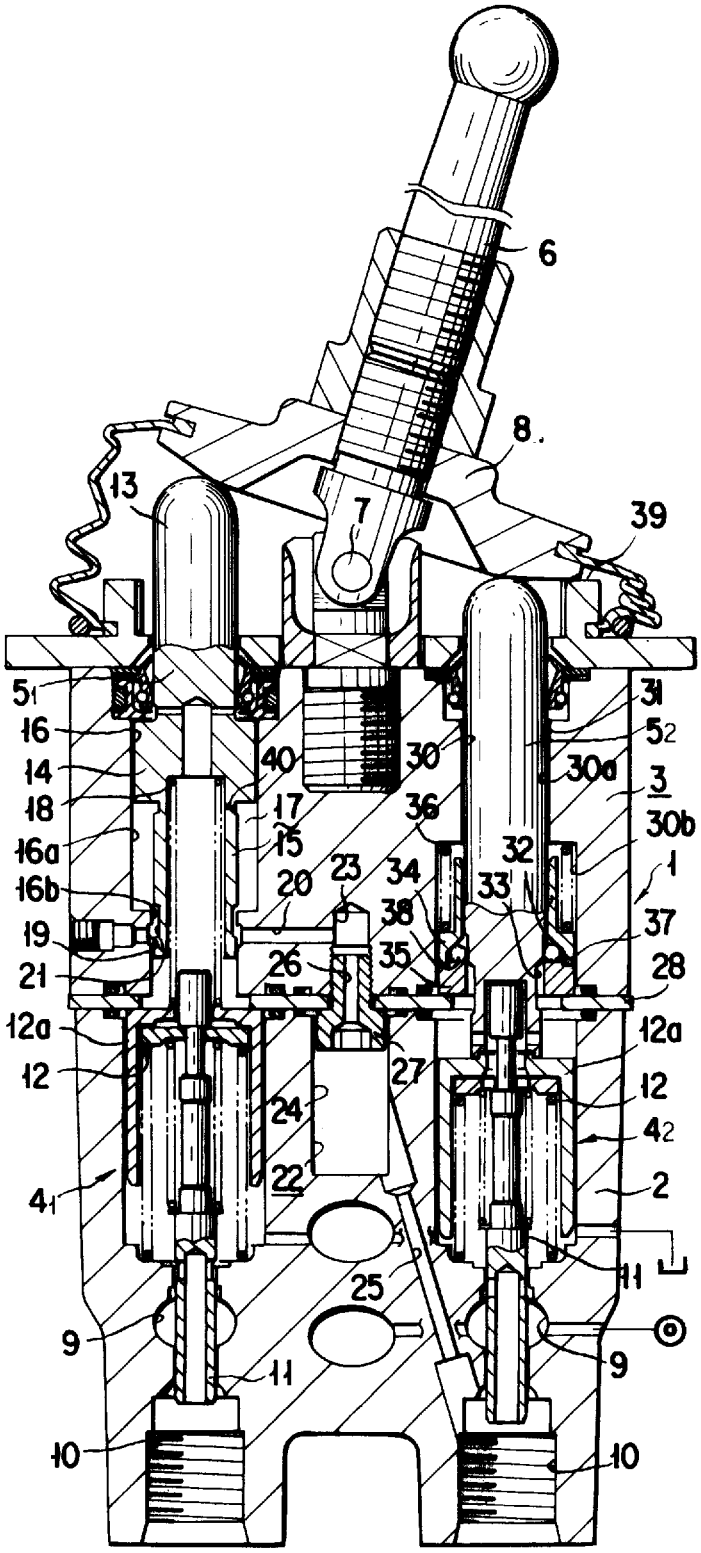
FIG. 2 is a sectional view showing a condition in which the first embodiment of a second pressure reduction valve portion is in a pressurized fluid supply condition.

When the operation lever 6 is rocked from the neutral position in the direction of arrow a to be placed at the actuating position shown in FIG. 2, the second piston $\mathbf{5}_2$ is pushed down by the pushing member 8 to push down the pressure regulating valve 11 of the second pressure reduction valve portion $\mathbf{4}_2$ against the spring 12. Thus, the second reduction valve portion $\mathbf{4}_2$ is moved into the pressurized fluid supply condition to supply the pressurized fluid through the outlet port 10 located at the right side of FIG. 2.

At this time, the operation lever 6 is rocked from the condition shown in FIG. 1 in the direction of arrow a to shift the second piston $\mathbf{5}_2$ downwardly for a certain distance. Then, the intermediate small diameter portion 32 pushes the ball 38 outwardly to push up the movable ring 34 against the bias of spring 36 to make the force necessary to push the second piston $\mathbf{5}_2$ downwardly greater. Thus, a force required to rock the operation lever 6 in the direction of arrow a becomes greater.

By further rocking the operation lever 6 in the direction of arrow a, the second piston $\mathbf{5}_2$ is shifted further downwardly to cause the pushing member 8 to abut onto the stopper 39 which defines the stroke end.

As set forth above, a boundary between a pilot pressure to be generated by the pressure regulating valve 11 by downward shifting of the second piston $\mathbf{5}_2$ before the force required for rocking the operation lever 6 downwardly becomes greater, and a pilot pressure to be generated by the pressure regulating valve 11 by further downward shifting of the second piston $\mathbf{5}_2$ after increasing the force required for pushing down, can be perceptible by an operator. By this, the operator may properly use the pilot pressure.

On the other hand, the first piston $5_1$ is pushed up by the spring 18 by upward shifting of the pushing member 8 to establish communication between the annular groove 19 and the pressure receiving chamber 17 by the cut-out 21 of the first piston $5_1$ corresponding to the position of the second piston $5_2$ at which the necessary operation force is varied. Therefore, the pressurized fluid output through the outlet port 10 of the second pressure reduction valve $4_2$, is supplied to the pressure receiving chamber 17 to further push up the first piston $5_1$.

Thus, when the hand is released from the operation lever 6, even if a force in the opposite direction to the arrow a is exerted on the operation lever 6 via the spring 12 of the second reduction valve portion $4_2$, the second piston $5_2$ and the pushing member 8, namely the force to return the operation lever 6 to the neutral position, the operation lever 6 can be retained at the actuating position by the force pushing up the first piston $5_1$ by the pressurized fluid supplied to the pressure receiving chamber 17.

In order to return the operation lever 6 to the neutral position from the condition set forth above, a force opposite to the arrow a is applied to the operation lever 6 to return to the neutral position by pushing down the first piston $5_1$ against the pressurized fluid of the pressure receiving chamber 17 to block the communication between the pressure receiving chamber 17 and the annular chamber 19.

It should be noted that when the first piston $5_1$ is pushed down, the pressurized fluid in the pressure receiving chamber 17 flows out to a drain side through a conduit 40.

Figure 3:
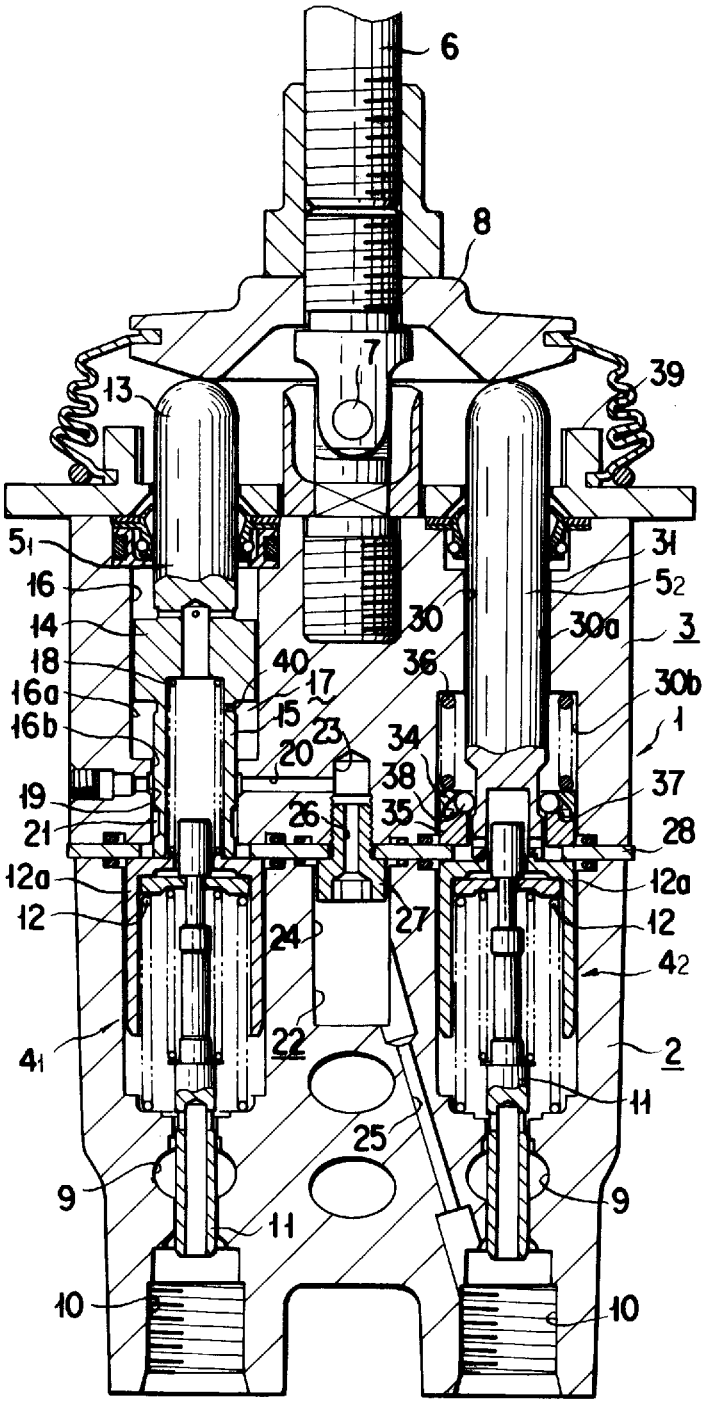
FIG. 3 is a sectional view showing the neutral position of a second embodiment of the hydraulic pilot valve according to the present invention.

Different from the first embodiment, the movable ring 34 may be an annular shape slidably engaged in the lower large diameter hole 30*b* of the second piston insertion bore 30, as in the second embodiment shown in FIG. 3.

Figure 4:
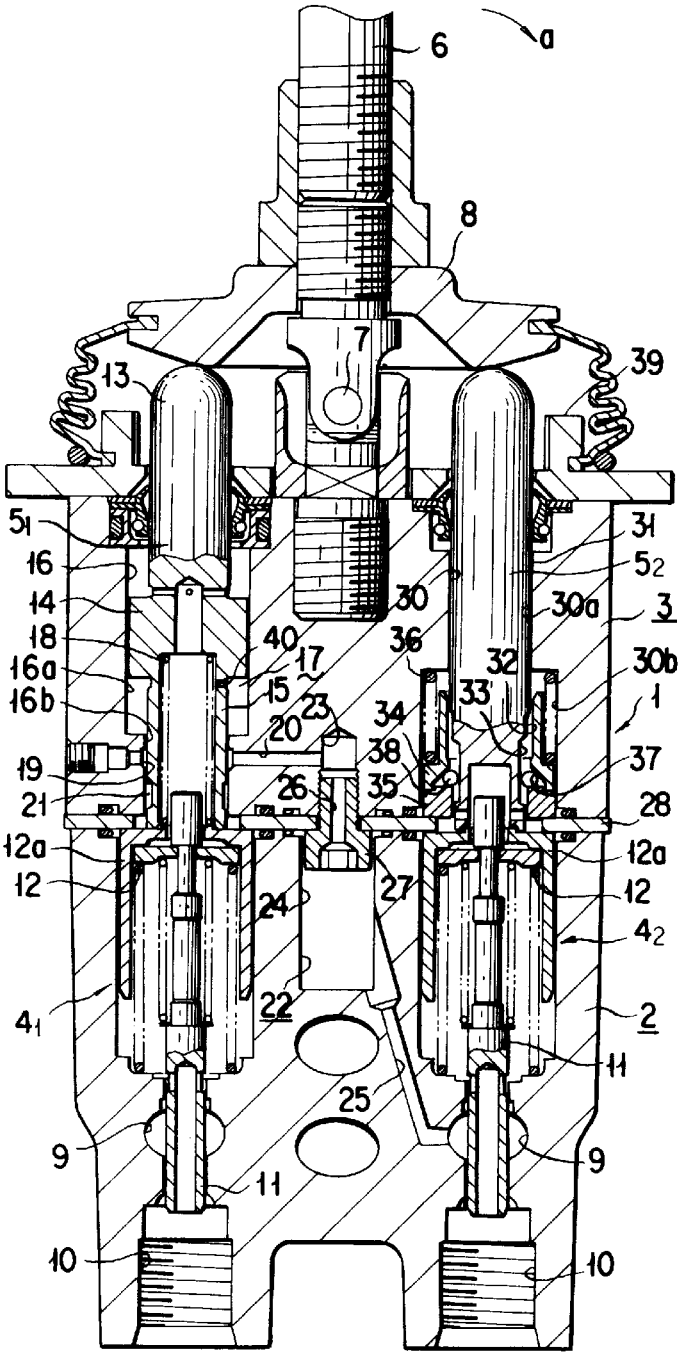
FIG. 4 is a section showing the neutral position of a third embodiment of the hydraulic pilot valve according to the present invention.

On the other hand, as in the third embodiment shown in FIG. 4, the fluid passage 25 may be constructed so as to communicate with the inlet port 9.

In this embodiment, when the operation lever 6 is rocked in the direction of arrow a, since the first piston $5_1$ is pushed up by the spring 18, the pressurized fluid output through the inlet port 9 of the second pressure reduction valve $4_2$ is supplied to the pressure receiving chamber 17 to further push up the first piston $5_1$. As a result, the operation lever 6 is retained at the actuating position.

In case of the first and second embodiments, since the fluid passage 25 is communicated with the outlet port 10, the pushing up force on the piston is variable depending upon the output force generated in the pressure receiving chamber 17. However, in case of the third embodiment, since the fluid passage 25 communicates with the inlet port 9, normally a constant piston pushing up force is generated in the pressure receiving chamber 17.

As set forth above, according to the hydraulic pilot valve according to the present invention, the operation lever 6 is operated in one direction from the neutral position to move one of the pressure reduction valve portion into the pressurized fluid supply condition, and to place the other piston 5 into a pushed up condition to open the switching valve portion. The pressurized fluid of one of the pressure reduction valve portions flows to the pressure receiving chamber 17 of the other piston 5 to push up and to retain the other piston 5 so that the operation lever 6 is maintained at the actuating position even when the operator'hand is released from the operation lever 6.

In addition, the only necessary construction therefor is forming the switching valve portion and the pressure receiving chamber 17 to supply the pressurized fluid via the switching valve portion to the pressure receiving chamber 17. Therefore, the number of parts can be reduced to make the overall construction compact and to reduce production costs.

Moreover, when the operation lever 6 is in the actuating position, the pressurized fluid at the output port 10 of the other pressure, reduction valve is supplied via the switching valve portion to the receiving chamber 17 of one of the pressure reduction valve portions. When the operation lever 6 is in the neutral position, the other pressure reduction valve portion is brought into the pressure supply stop condition so that the pressurized fluid does not flow through the switching valve portion so as not to cause fluid leakage or so forth.

Furthermore, when the operation lever 6 is rocked at an angle greater than or equal to a predetermined angle, resistance against further downward movement of the other pressure reduction valve portion is abruptly increased so that the operator operating the operation lever 6 may perceive the specific operation magnitude.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as being limited to the specific embodiments set out above but to include all possible embodiments which can be embodied within a scope encompassed by the appended claims and equivalents thereof with respect to the features set forth in the appended claims.

We claim:

1. A hydraulic pilot valve comprising:

a plurality of pressure reduction valve portions, each of said pressure reduction valve portions having an inlet port, an outlet port and a pressure regulating valve for establishing and blocking communication between said inlet and outlet ports by movement of said pressure regulating valve;

a plurality of pistons for moving said pressure regulating valves of said pressure reduction valve portions in a direction establishing communication between said inlet and outlet ports, respectively;

an operation lever having a pushing member for pushing said plurality of pistons, by rocking said operation lever from a neutral position in a direction so as to place said operation lever at an actuating position at which one of said pistons is pushed to place one of said pressure reduction valve portions in a pressurized fluid supply condition to establish communication between said inlet portion and said outlet portion;

a plurality of springs for biasing said pistons upwardly beyond a predetermined neutral position to retain said pistons in an abutting relation with said pushing member;

a switching valve portion provided in the other of said pistons, said switching valve portion moving to an open position when said other piston is pushed in an upward direction;

a pressure receiving chamber for pushing up at least one of said pistons, other than said one piston, so as to maintain said operation lever at the actuating position, said pressure receiving chamber communicating with said outlet port of said one pressure reduction valve portion via said switching valve portion; and a resistance device, disposed adjacent said one piston, for increasing resistance to a downwardly directed pushing force applied to said one piston when said one piston is pushed down beyond a predetermined distance by said pushing member.

2. The hydraulic pilot valve as claimed in claim 1, wherein said switching valve portion is constructed with a port which communicates with said outlet port of said one pressure reduction valve portion, and a cut-out portion which establishes communication between said pressure receiving chamber and said port when said piston moves upwardly beyond the neutral position by a predetermined distance.

3. A hydraulic pilot valve comprising:

a valve body defining a first valve bore communicating with a first input port and a first output port, a second valve bore communicating with a second input port and a second output port, and a fluid passage communicating said first bore with said second output port, wherein said first valve bore is parallel to said second valve bore;

a first valve reduction portion slidably disposed in said first valve bore;

a second valve reduction portion slidably disposed in said second valve bore;

a first pressure regulation valve connected to said first valve reduction portion for establishing and blocking communication between said first input port and said first output port;

a second pressure regulation valve connected to said second valve reduction portion for establishing and blocking communication between said second input port and said second output port;

a first piston slidably disposed in an upper portion of said first valve bore and connected to said first pressure reduction valve portion, said first piston extending outwardly of said valve body;

a second piston slidably disposed in an upper portion of said second valve bore and connected to said second pressure reduction valve portion, said second piston extending outwardly of said valve body;

a pushing member pivotally connected to said valve body and engaging an upper end of each of said first and second pistons;

a first spring member biasing said first piston upwardly into contact with said pushing member;

a second spring member biasing said second piston upwardly into contact with said pushing member;

an operating lever connected to said pushing member; and a resistance device disposed adjacent to an outer peripheral surface of a lower reduced diameter portion of said second piston for increasing resistance to downward movement of said second piston, wherein, as said operating lever is moved from a neutral position to an actuating position, said pushing member is pivoted in a direction to push said second piston downwardly to establish communication between said second input port and said second output port.

4. The hydraulic pilot valve as claimed in claim 3, wherein said first valve bore comprises a stepped upper portion defining an upper large diameter section and a lower small diameter section having an annular groove communicating with said fluid passage which communicates said first bore with said second output port, and said first piston comprises:

an upper small diameter portion;

an intermediate large diameter portion slidably engaging an interior peripheral surface of said upper large diameter section of said first bore; and a lower small diameter portion slidably engaging an interior peripheral surface of said lower diameter section of said first bore, said lower small diameter portion having an annular cutout portion for establishing communication between said annular groove and a pressure receiving chamber defined by a lower surface of said intermediate large diameter portion of said first piston, an outer peripheral surface of said lower small diameter portion of said first piston, and said interior peripheral surface of said upper large diameter section of said stepped upper portion of said first bore.

5. The hydraulic pilot valve as claimed in claim 3, wherein said resistance device comprises:

a stationary ring surrounding said lower reduced diameter portion of said second piston;

a movable ring surrounding said second piston and elastically biased into engagement with said stationary ring, said movable ring having an inner peripheral tapered surface;

at least one ball disposed between said tapered surface of said movable ring and an outer peripheral surface of said lower reduced diameter portion of said second position in said neutral position.

6. The hydraulic pilot valve as claimed in claim 3, wherein said valve body comprises:

an upper body; and a lower body connected to said upper body by a hollow threaded plug disposed in said fluid passage.

7. The hydraulic pilot valve as claimed in claim 3, further comprising a stopper provided adjacent said first and second pistons to limit the movement of said pushing member.

* * * * *